US010449438B2

(12) United States Patent
Hashiba

(10) Patent No.: US 10,449,438 B2
(45) Date of Patent: Oct. 22, 2019

(54) TOY TOP

(71) Applicant: TOMY COMPANY, LTD., Tokyo (JP)
(72) Inventor: Kenta Hashiba, Tokyo (JP)
(73) Assignee: TOMY COMPANY, LTD., Tokyo (JP)

( * ) Notice: Subject to any disclaimer, the term of this patent is extended or adjusted under 35 U.S.C. 154(b) by 0 days.
(21) Appl. No.: 15/892,667
(22) Filed: Feb. 9, 2018
(65) Prior Publication Data
US 2018/0229109 A1 Aug. 16, 2018
(30) Foreign Application Priority Data
Feb. 10, 2017 (JP) ..... 2017-023036
(51) Int. Cl.
*A63F 9/16* (2006.01)
*A63H 1/02* (2006.01)
*A63F 3/00* (2006.01)
*A63H 1/00* (2019.01)
*A63H 1/04* (2006.01)
(52) U.S. Cl.
CPC ..... *A63F 9/16* (2013.01); *A63F 3/00895* (2013.01); *A63H 1/00* (2013.01); *A63H 1/02* (2013.01); *A63H 1/04* (2013.01)
(58) Field of Classification Search
CPC ..... A63H 1/18; A63H 1/04; A63F 7/00
See application file for complete search history.

(56) References Cited

U.S. PATENT DOCUMENTS

2003/0064660 A1* 4/2003 Matsukawa ..... A63F 3/00895 446/256
2007/0205554 A1* 9/2007 Elliott ..... A63F 9/16 273/126 R
2014/0302743 A1* 10/2014 Cai ..... A63H 1/18 446/256
2014/0378024 A1* 12/2014 Choi ..... A63H 1/26 446/261

FOREIGN PATENT DOCUMENTS

| | | |
|---|---|---|
| CN | 204073390 U | 1/2015 |
| JP | 3083443 | 1/2002 |
| JP | 2004-275484 | 10/2004 |
| JP | 2006-055333 | 3/2006 |
| JP | 3149384 | 3/2009 |

OTHER PUBLICATIONS

European Patent Office English abstract for Japanese Patent Publication No. 2004-275484, published Oct. 7, 2004.
English abstract for Japanese Patent Publication No. 3149384, published Mar. 4, 2009.
Espacenet English abstract for Chinese Patent Publication No. 204073390 U, published Jan. 7, 2015.
European Office Action dated Sep. 12, 2018 in Application No. 18156013.7.
Office Action for Japanese Patent Application No. 2017-023036, dated Oct. 10, 2017.
J-Plat Pat English Abstract for Japanese Patent Application Publication No. 2006-055333, published Mar. 2, 2006.

* cited by examiner

*Primary Examiner* — Eugene L Kim
*Assistant Examiner* — Christopher Glenn
(74) *Attorney, Agent, or Firm* — Staas & Halsey LLP

(57) ABSTRACT

A toy top includes a body and a bump for attack which is disposed on a circumference of the body. The bump moves up and down according to a force acting on the bump while the toy top spins.

14 Claims, 8 Drawing Sheets

TOY TOP

BACKGROUND OF THE INVENTION

1. Field of the Invention

The present invention relates to a toy top.

2. Description of Related Art

A battle game using toy tops that has been known in the art involves forcing toy tops to collide with each other so that a resultant impact force stops the spinning of an opponent toy top or knocks out or disassembles the opponent toy top.

Some of such toy tops are designed to include attack and the defense structures that are changeable. For example, an attachment with a bump is attached to a toy body, and the bump has such a shape that allows changing the attack or the defense (e.g. see Japanese Utility Model No. 3083443).

The attachment disclosed in Japanese Utility Model No. 3083443 is designed to impart different attack and defense according to whether it is attached in the face-up or face-down position, so that the attack and the defense are changeable by attaching it in the flipped position. However, flipping the attachment can be time-consuming and distract from the game.

SUMMARY OF THE INVENTION

The present invention has been made in view of this problem in the prior art, and an object thereof is to provide a toy top that changes its function while spinning.

According to an aspect of the present invention, a toy top includes:

a body; and a bump for attack which is disposed on the circumference of the body, wherein the bump moves up and down according to a force acting on the bump while the toy top spins.

Preferably, a guide groove is formed in one of the body and the bump, and a projection is formed on another of the body and the bump. The guide groove includes an inclined groove portion which has a predetermined inclination with respect to a horizontal plane so as to be an upward slope to a rear side in a spinning direction of the toy top. The bump is engaged with the body by inserting the projection into the guide groove. The bump moves up and down relative to the body according to a direction of the force acting on the bump while the toy top spins.

This can reduce an impact from an opponent toy top during spinning or change the attack function during spinning.

Preferably, the guide groove is formed in the body, and the projection is formed on the bump.

This allows the bump to move in a wide range regardless of the size of the bump.

Preferably, the guide groove includes a flat groove portion or a gently inclined groove portion which continues to the inclined groove portion, in which the gently inclined portion has gentler inclination than the inclined groove portion.

In this configuration, the flat groove portion and the gently inclined groove portion have different resistance from the inclined groove portion. This allows the bump to move differently between an early stage and a late stage of movement.

Preferably, the body includes an upper plate and a lower plate which include respective wall/groove portions. The guide groove is formed by putting the upper plate with the lower plate together and thereby bring the groove/wall portions of the upper plate and the lower plate together.

In this configuration, the groove/wall portions are formed respectively in the upper and lower plates. This can simplify the engaging mechanism between the projection and the groove.

Preferably, the toy top further includes a ring which is coaxial with the body, and the bump includes a plurality of bumps formed on the ring.

This facilitates assembly of the toy top.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION

Figure 1:
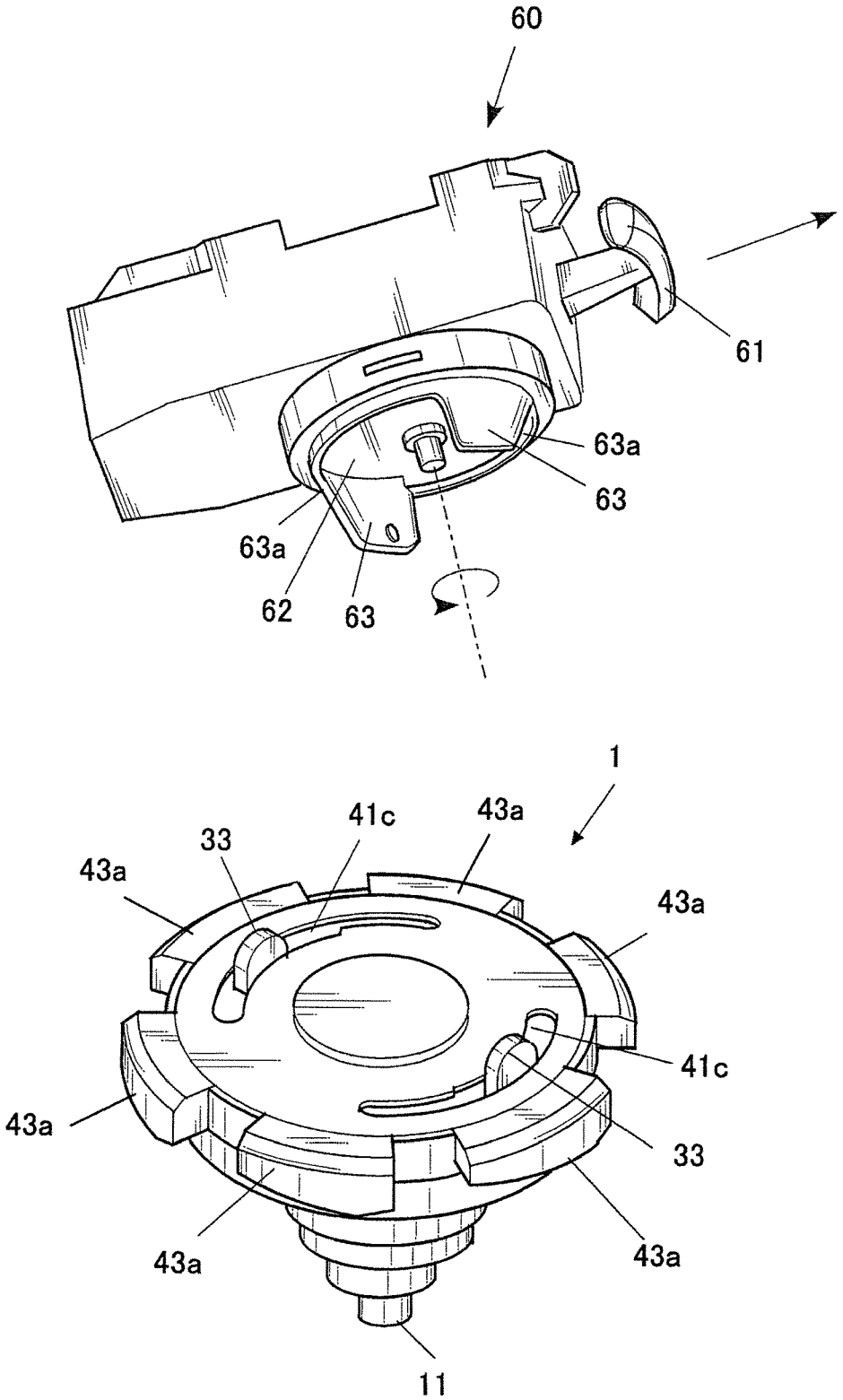
FIG. 1 is a perspective view of a toy top according to an embodiment and a launcher.

Hereinafter, the toy top of the present invention will be described based on the embodiments illustrated in the drawings.

FIG. 1 illustrates a toy set composed of a toy top 1 according to a first embodiment and a launcher 60.

Figure 2:
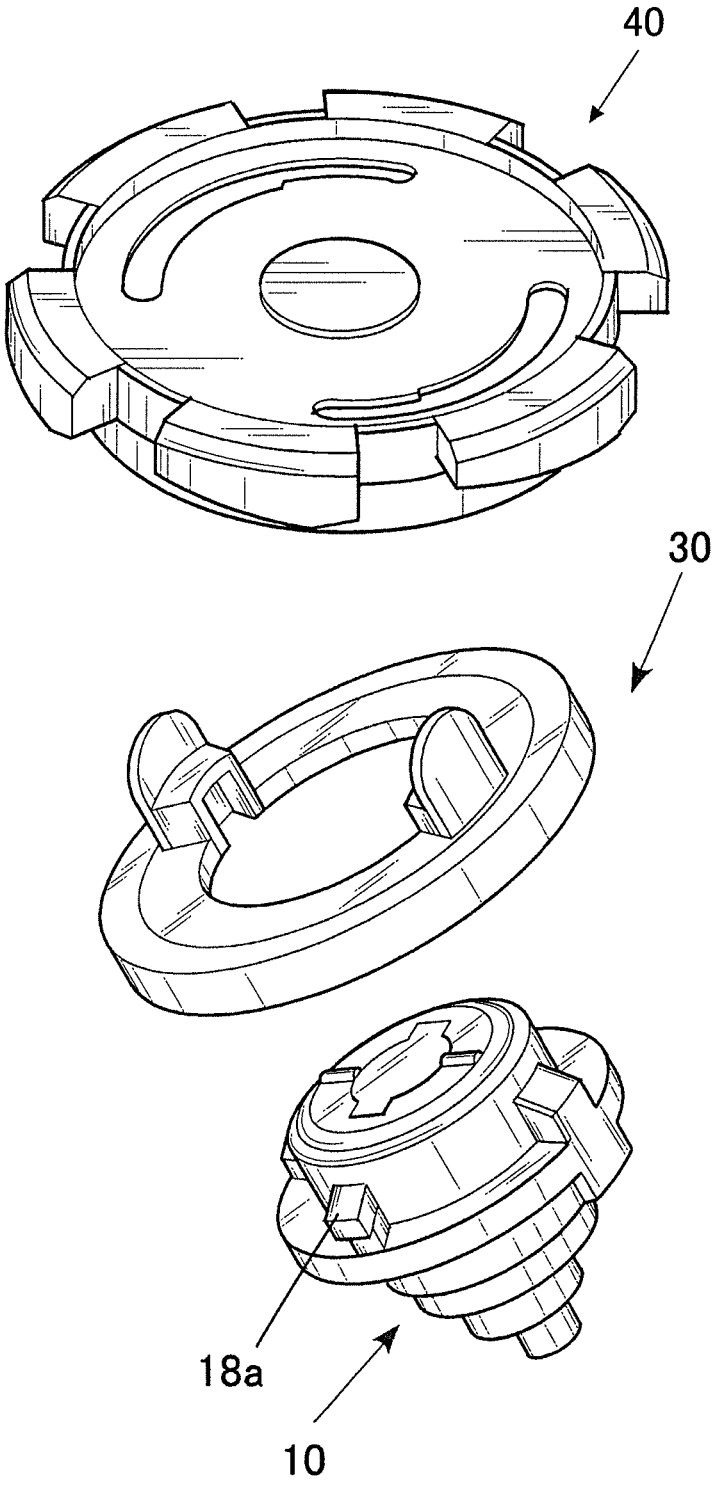
FIG. 2 is a perspective view illustrating how to play a toy top according to a first embodiment.

The toy top 1 can be used in a so-called battle game. For example, the toy top 1 is used in a battle game in which toy tops are forced to collide with each other to disassemble an opponent's toy top 1, as illustrated in FIG. 2, by an impact force.

Figure 3:
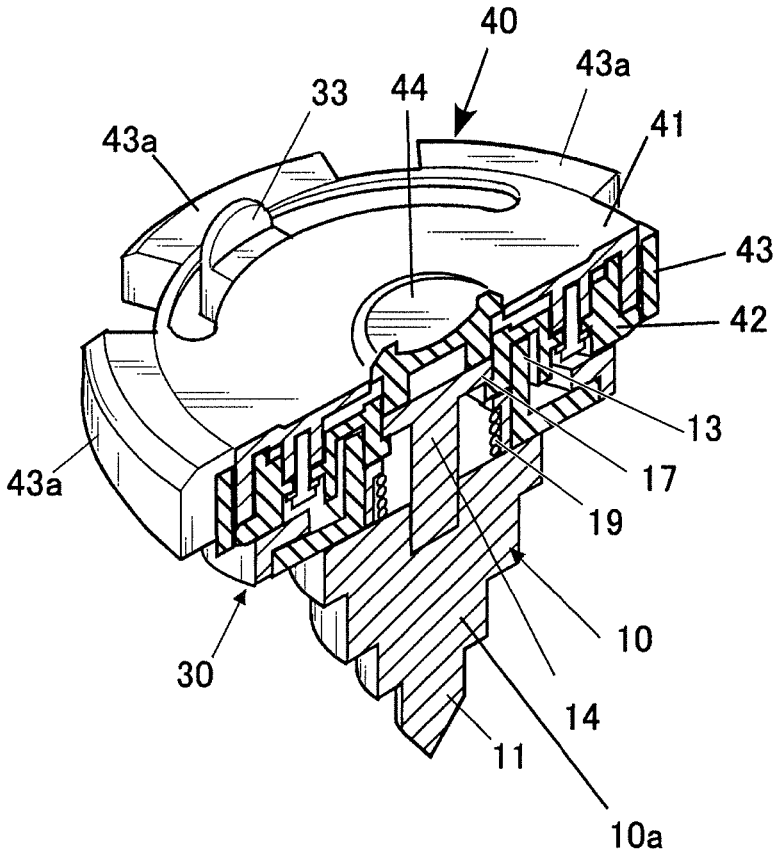
FIG. 3 is a semi-sectional perspective view of the toy top according to the first embodiment.
Figure 4:
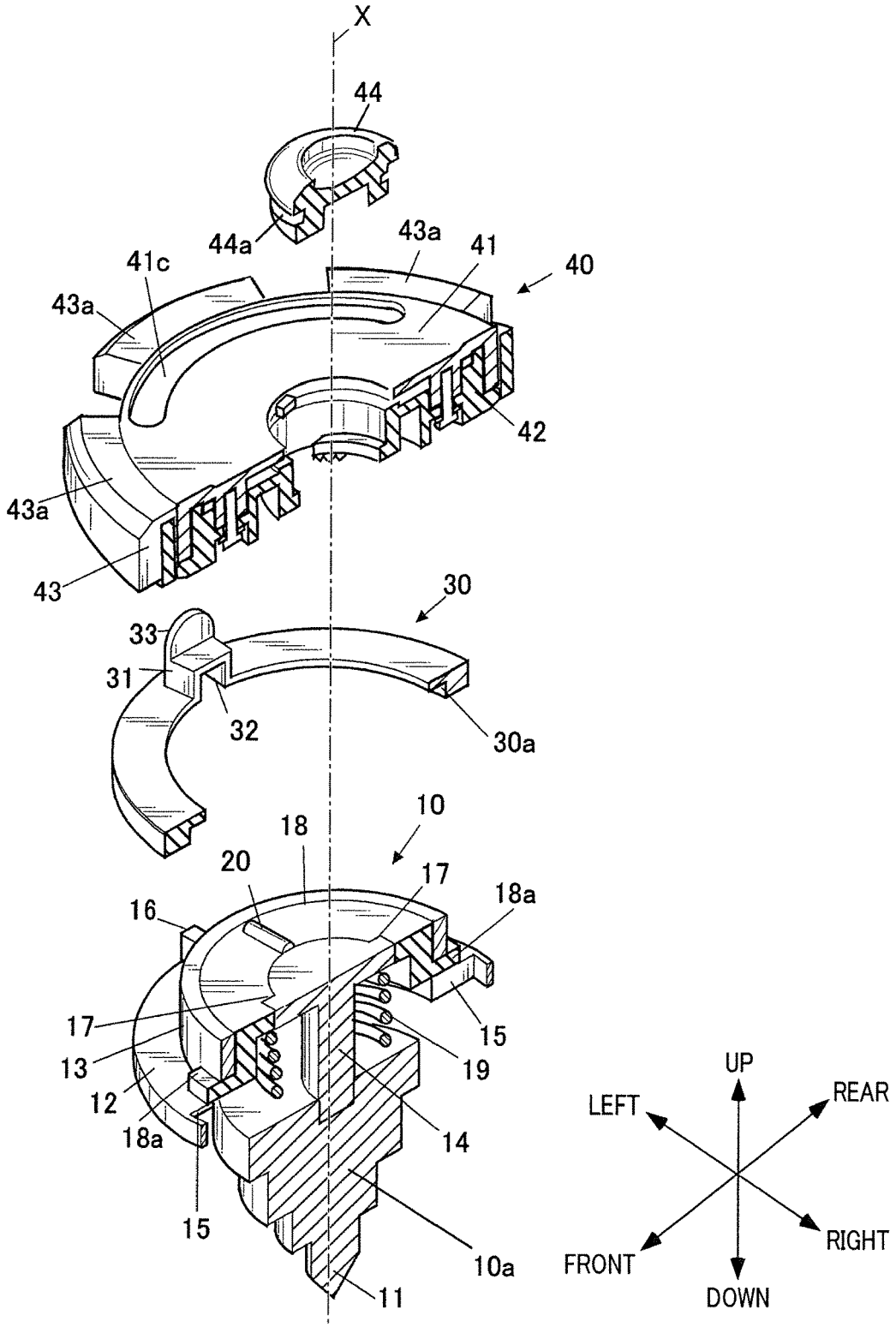
FIG. 4 is an exploded perspective view of the toy top according to the first embodiment.

As illustrated in FIG. 3 and FIG. 4, the toy top 1 is composed of a shaft portion 10, a flywheel 30 and a body 40. While FIG. 3 and FIG. 4 illustrate a half section of the toy top 1, the unshown half is symmetric about the center axis X. As used herein, the terms up-down, right-left and front-rear refer respectively to the directions as illustrated in FIG. 4.

As illustrated in FIG. 4, the shaft portion 10 includes a spinning shaft 11 at a lower end, a flange 12 in a middle in the up-down direction, and a cylinder 13 at an upper end.

The flange 12 and the cylinder 13 are preferably integrally formed with each other. In the center of the cylinder 13, a pillar 14 is disposed. At an upper end of the pillar 14, two hooks 17 protrude radially outward from the front and rear sides. The pillar 14 is fixed to the lower shaft portion 10*a*. The lower shaft portion 10*a* is formed in an approximately reversed conical shape with a diameter that reduces stepwise in a direction from the flange 12 to a bottom tip of the spinning shaft 11. The lower shaft portion 10*a* may be fixed to the flange 12 by a screw or the like (not shown).

Each of the flange 12 and the cylinder 13 has two holes 15 at the front and rear sides, which penetrate through the flange 12 and the cylinder 13. On the outer circumferential face of the cylinder 13, two protrusions 16 are formed at the right and left sides. Outer faces of the protrusions 16 are flush with an outer circumferential face of the flange 12.

The shaft unit 10 also includes a cylindrical pressing member 18 around the pillar 14 and inside the cylinder 13. At a lower end of an outer circumference of the pressing member 18, two legs 18*a* extend radially outward at the front and rear sides.

The pressing member 18 is attached such that the legs 18*a* are exposed through the holes 15 as illustrated in FIG. 4. The holes 15 allow the legs 18*a* to move in the up-down direction, but upper edges of the holes 15 restrict further upward movement. The pressing member 18 is biased upward by a spring 19, and an upper end face of the pressing member 18 is approximately at the same height as an upper end of the cylinder 13 in an ordinary state.

On the upper face of the pressing member 18, two ridges (protrusions) 20 extend in a radial direction at the right and left sides.

The flywheel 30 is formed in a ring shape. At an inner side of a bottom face of the flywheel 30, an annular step 30*a* is formed so that the flange 12 of the shaft unit 10 can be received therein from the lower side. On an upper face of the flywheel 30, two protrusions 31 protrude upward from the right and left sides. In lower parts of the protrusions 31, recesses 32 are formed so that the protrusions 16 of the shaft portion 10 can be received therein. On the upper face of the flywheel 30, tongues 33 extend upward along an outer side of the protrusions 31. The tongues 33 protrude higher than the protrusions 31.

Figure 5:
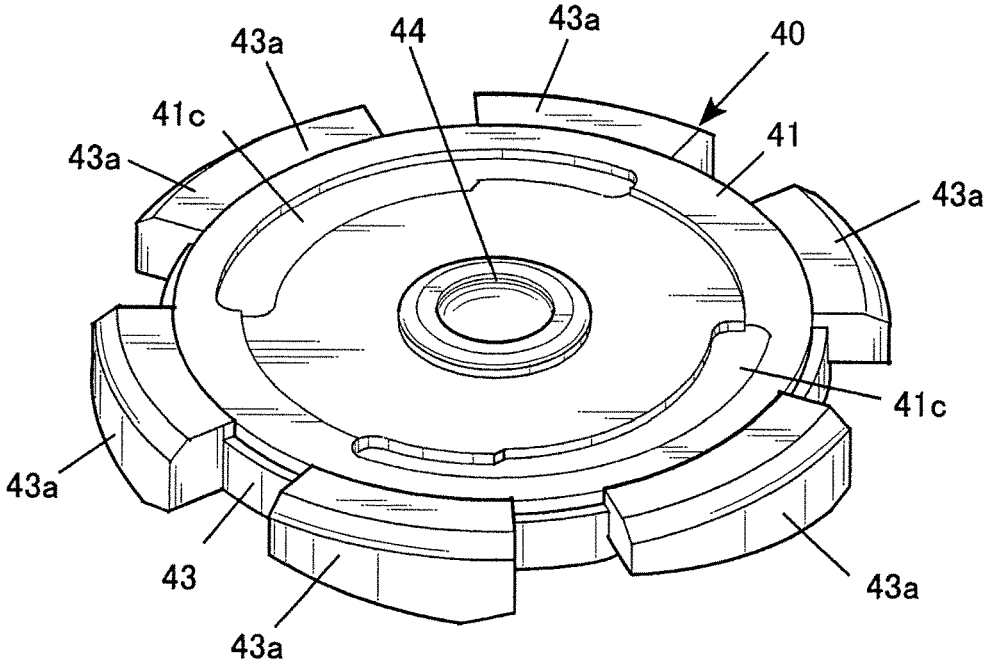
FIG. 5 is a perspective view of a body of the toy top according to the first embodiment.
Figure 6:
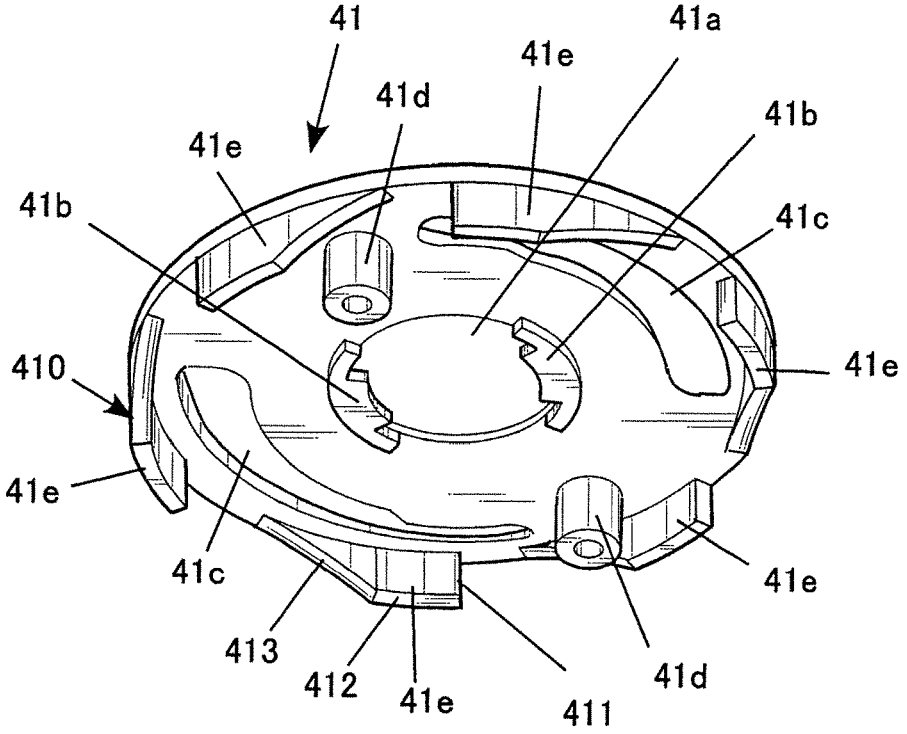
FIG. 6 is a perspective view from below of an upper plate of the toy top according to the first embodiment.
Figure 7:
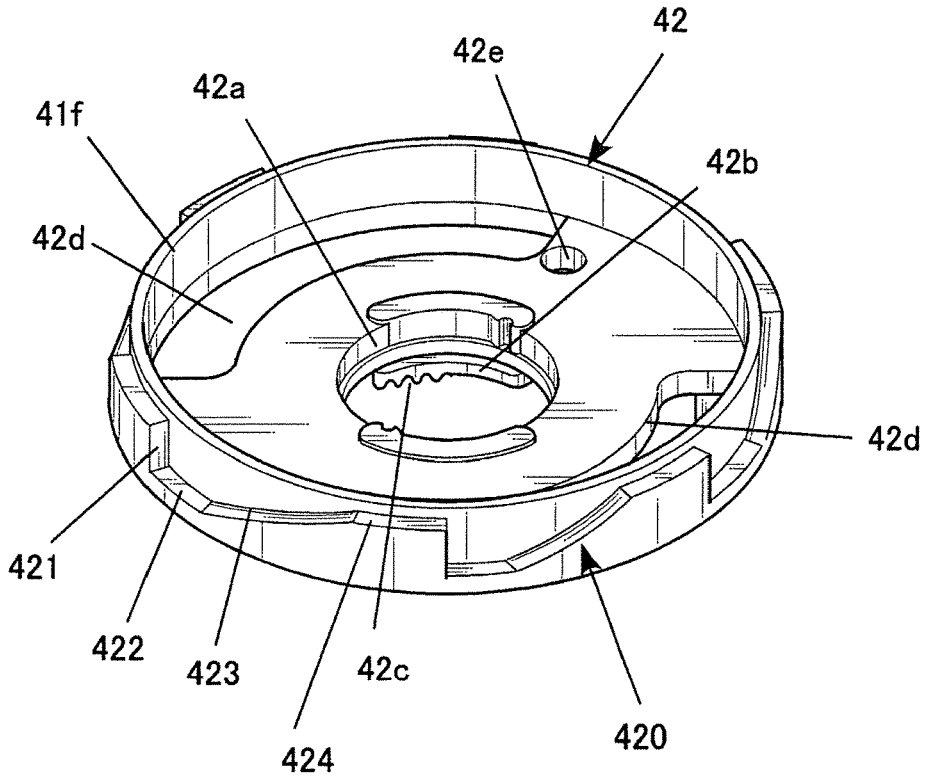
FIG. 7 is a perspective view from above of a lower plate of the toy top according to the first embodiment.
Figure 8:
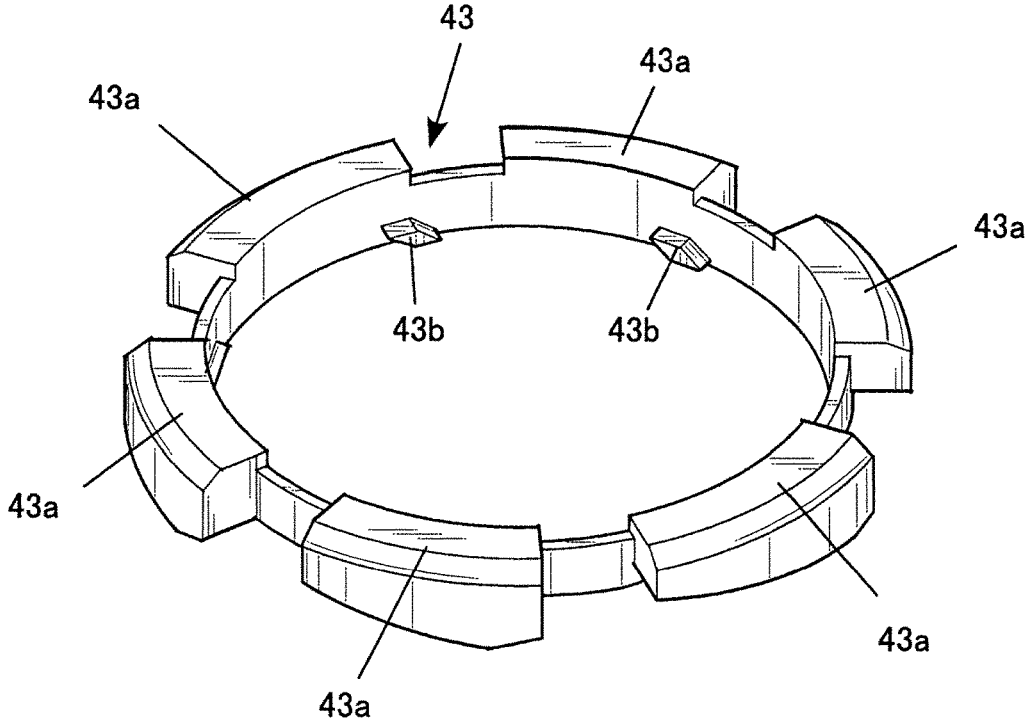
FIG. 8 is a perspective view from above of a ring of the toy top according to the first embodiment.

FIG. 5 is a perspective view of the body 40 from above, FIG. 6 is a perspective view of an upper plate from below, FIG. 7 is a perspective view of a lower plate 42 from above, and FIG. 8 is a perspective view of a ring 43 from above.

The body 40 includes the upper plate 41, the lower plate 42 and the ring 43. In the following description, the term "spinning front" refers to the front side in the spinning direction of the toy top 1, and the term "spinning rear" refers to the rear side in the spinning direction of the toy top 1.

At a center of the upper plate 41, a circular hole 41*a* is formed. At an edge of the hole 41*a* on a bottom face of the upper plate 41, two protrusions 41*b* that protrude radially inward are mutually opposed across a center axis of the toy top 1. The protrusions 41*b* are provided to attach a cylindrical decoration part 44 as illustrated in FIG. 4. The decoration part 44 may identify the toy top owner, different toy tops, etc. Upper faces of the decoration parts 44 may have different colors and/or shapes. The decoration parts 44 preferably have a cylindrical shape, and grooves 44*a* may be formed on the outer circumferential face for fitting the protrusions 41*b*. A decoration part 44 is attached to the upper plate 41 by vertically mating inlets of the grooves 44*a* with the protrusions 41*b* and then turning the decoration part 44 in a predetermined direction to engage edges of the grooves 44*a* with the protrusions 41*b*.

In the upper plate 41, two arc slits 41*c* are mutually opposed across the center axis, to which the tongues 33 of the flywheel 30 can be inserted from the lower side. The slits 41*c* are wider at one end than the other end in the circumferential direction.

On the underside of the upper plate 41, two cylindrical bosses 41*d* are mutually opposed across the center axis. Inner faces of holes of the bosses 41*d* are formed as screw threads (not shown).

The bottom face of the upper plate 41 forms a plane (horizontal plane) perpendicular to the center axis. Along an outer circumference of the bottom face of the upper plate 41, six protruded wings 41*e* protrude downward. Each of the protruded wings 41*e* is formed in an arc shape in a view from below. Further, the protruded wings 41*e* are formed in a sawtooth shape in a view from the outside in the radial direction.

That is, each of the protruded wings 41*e* includes:

a vertical face 411 that is at the spinning front end and perpendicular to the bottom face of the upper plate 41;

a flat face 412 that is in the spinning front side and perpendicular to the center axis and that continues to a lower end of the vertical face 411; and an inclined face 413 that is in the spinning rear side and inclined upward in a direction to the spinning front and that continues to the flat face 412.

The protruded wings 41*e* together with the parts of the bottom face of the upper plate 41 exposed in gaps between adjacent protruded wings 41*e* constitute a groove/wall portion 410. Along the outer circumference of the bottom face of the upper plate 41, the six protruded wings 41*e* are formed at regular spacings in the circumferential direction.

On the lower plate 42, an inner ring wall (cylinder) 42*a* with the same inner diameter as the diameter of the hole 41*a* protrudes downward as illustrated in FIG. 7. On a lower end of an inner face of the ring wall 42*a*, two hooks 42*b* that protrude radially inward are mutually opposed across the center axis. At ends of bottom faces of the hooks 42*b*, uneven portions 42*c* are formed in which recesses are successively formed to mesh with the ridges 20 of the shaft portion 10.

The lower plate 42 has arc slits 42*d* that are located below the slits 41*c* of the upper plate 41, and holes 42*e* in which the bosses 41*d* of the upper plate 41 are inserted.

Along the circumference of the lower plate 42, an outer ring wall 41*f* is formed. The outer ring wall 41*f* is partly missing so as to constitute a groove/wall portion 420. The groove/wall portion 420 is formed from six sections arrayed in the circumferential direction, each of which is composed of a standing face 421 that contacts with the vertical face 411, a flat face 422 that is opposed to the flat face 412, an inclined face 423 that is opposed to the inclined face 413 and a flat face 424 that is opposed to the part of the upper plate 41 exposed between adjacent protruded wings 41*e*.

Figure 9:
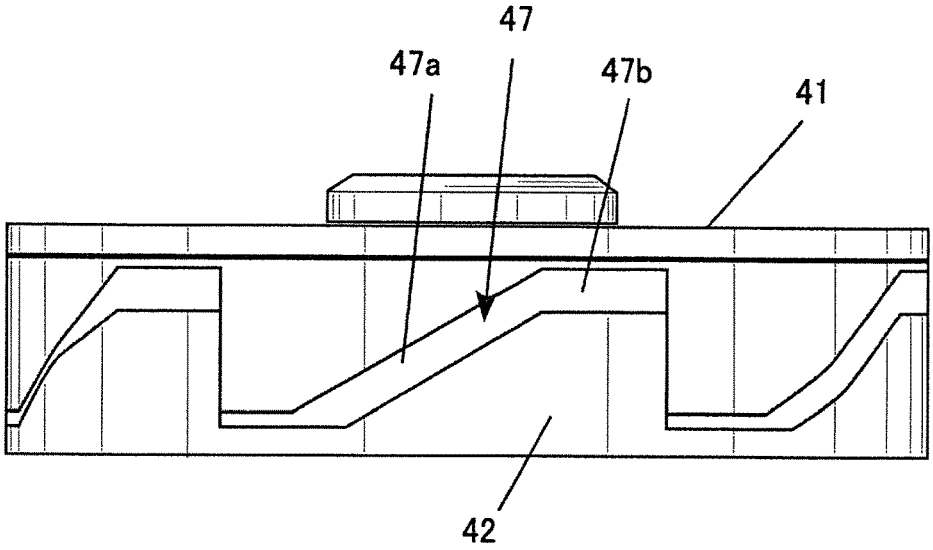
FIG. 9 illustrates grooves of the toy top according to the first embodiment.

When the upper plate 41 and the lower plate 42 are put together, the groove/wall portion 420 and the groove/wall portion 410 mesh with each other to form six guide grooves 47 in the outer circumference of the body composed of the upper plate 41 and the lower plate 42 as illustrated in FIG. 9.

Specifically, each of the guide grooves 47 includes an inclined groove portion 47*a* that is an upward slope in the direction from the spinning front side to the spinning rear end and a flat groove portion 47*b* that is formed in the spinning rear side and continues to the inclined groove portion 47*a*.

On the outer circumference of the ring 43, six attack bumps 43*a* that project radially outward are formed at regular spacings in the circumferential direction. The upper faces of the bumps 43*a* are approximately flat. In contrast, the lower faces of the bumps 43*a* are inclined downward in the direction from the spinning front end to the spinning rear side and then upward in the spinning rear portion in a view from the outside in the radial direction of the ring 43.

On an inner circumference of the ring 43, projections 43*b* are formed, which are inserted in the respective guide grooves 47. The projections 43*b* are formed in a rhombic shape in a view from the inside in the radial direction.

The ring 43 is attached to the upper plate 41 and the lower plate 42 as follows.

For example, before the upper plate 41 and the lower plate 42 are put together, the upper plate 41 is placed in the flipped position, the ring 43 in the flipped position is placed thereon, and the lower plate 42 in the flipped position is placed further thereon. Then, screws with washers (not shown) are inserted in the bosses 41*d* of the upper plate 41 through the lower plate 42. In this way, the ring 43 is attached to the upper plate 41 and the lower plate 42.

Next, the assembling method of the toy top 1 will be described.

The shaft portion 10 and the body 40 have been already assembled individually as illustrated in FIG. 4.

First, the shaft portion 10 is fitted in the flywheel 30 from the lower side such that the protrusions 16 of the shaft portion 10 mate with the recesses 32 of the flywheel 30. Subsequently, the assembly is brought toward the body 40 from the lower side. In this step, the tongues 33 of the flywheel 30 of the assembly are inserted into the arc slits 41*c* of the body 40 through the slits 42*d*. In this state, the hooks 17 of the shaft portion 10 do not overlap the hooks 42*b* of the body 40 in the up-down direction. This state is referred to as a coupling releasable state. Thereafter, the shaft unit 10 of the assembly is pushed toward the body 40. Then the flywheel 30 firstly abuts the bottom face of the body 40. Then, when the spring 19 in the shaft portion 10 is compressed and the pressing member 18 is moved down accordingly, the hooks 17 of the shaft portion 10 are relatively pushed up higher than the hooks 42*b* of the lower plate 42 portion of the body 40. Subsequently, the shaft portion 10 together with the flywheel 30 is turned relative to the body 40 in a predetermined direction. After this step, the hooks 17 of the shaft portion 10 are aligned with the hooks 42*b* of the body 40 in the vertical direction. When the hand is removed from the shaft portion 10, the lower face of the hooks 17 of the shaft portion 10 abuts the upper face of the hooks 42*b* of the body 40 by the action of the biasing force of the spring 19 in the shaft portion 10. This state, in which the bottom faces of the hooks 17 of the shaft portion 10 are in contact with the upper faces of the hooks 42*b* of the body 40, is referred to as a coupled state. In this way, the shaft portion 10 is coupled with the flywheel 30 and the body 40. The toy top 1 is thus assembled.

Next, an example of how to play the toy top 1 will be described.

FIG. 1 is a perspective view of an example of a launcher for spinning the toy top 1.

In this example, a player spins a toy top 1 and forces it to battle with an opponent toy top 1.

In such cases, the launcher 60 is used to apply a spinning force to the toy top 1. The launcher 60 includes a disk (not shown) therein. The launcher 60 is configured such that when an operating member, such as a string or rack of teeth (not shown) is pulled by a handle 61 while a spiral spring (not shown) biases the disk in a certain rotational direction, the disk is rotated, and a top holder 62 is rotated accordingly. The rotation of the top holder 62 is transmitted to the toy top 1 through a fork 63 that protrudes downward, so that the toy top 1 is rotated. When the fork 63 is inserted in the arc slits 41*c* of the body 40 and engaged with the narrow ends of the arc slits 41*c*, and when the handle 61 of the launcher 60 is completely pulled out of the launcher, the disk and the top holder 62 stop rotating while the toy top 1 continues rotating by the action of its inertial force. As a result, the toy top 1 descends from the top holder 62 following the inclined faces 63*a* of the fork 63.

The toy top 1 thus launched is led to a predetermined playing field where it spins in a predetermined direction. When the toy top 1 collides with an opponent toy top 1, the impact of the collision produces a force that acts on the body 40 in the direction opposite to the spinning direction of the shaft portion 10 and the flywheel 30, and the body 40 thereby relatively turns in the direction opposite to the spinning direction of the shaft portion 10 and the flywheel 30.

This turn of the body 40 relative to the shaft portion 10 changes the engaged position between the uneven portions 42*c* on the bottom face of the body 40 and the ridges 20 on the shaft portion 10. When the ridges 20 reach an engagement releasing position, the hooks 42*b* of the body 40 are released from the hooks 17 of the shaft portion 10 so that the body 40 separates from the shaft portion 10 by the action of the biasing force of the spring 19 in the shaft unit 10. As a result, the toy top 1 is disassembled as illustrated in FIG. 2.

Before and during the battle, the bumps 43*a* function as follows.

Figure 10A:
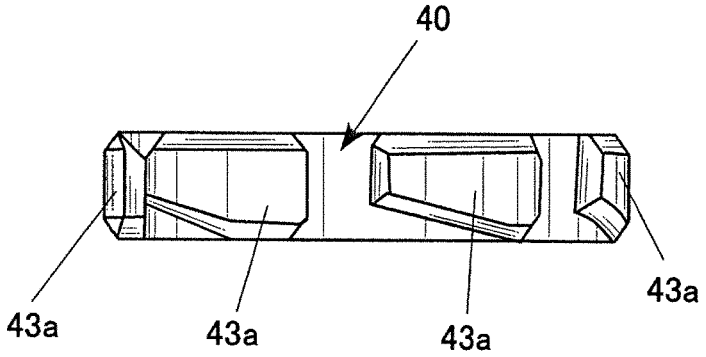
FIG. 10A illustrates the movement of bumps of the toy top according to the first embodiment, where the bumps are at the lower position.
Figure 10B:
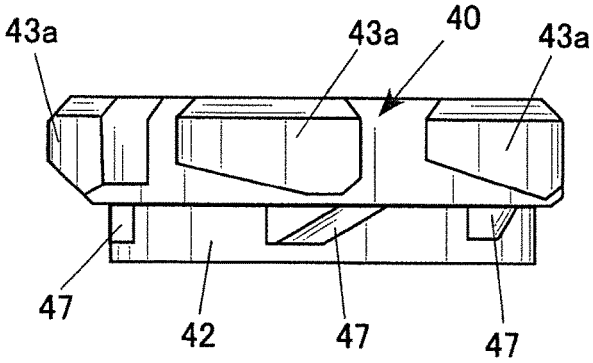
FIG. 10B illustrates the movement of bumps of the toy top according to the first embodiment, where the bumps are at the upper position.
Figure 11A:
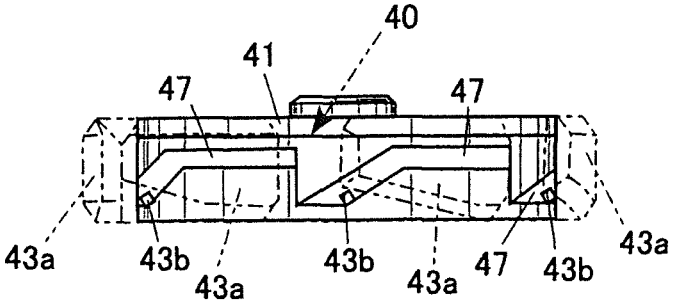
FIG. 11A illustrates an engaging mechanism between projections and the grooves according to the first embodiment, where the bumps are at the lower position.
Figure 11B:
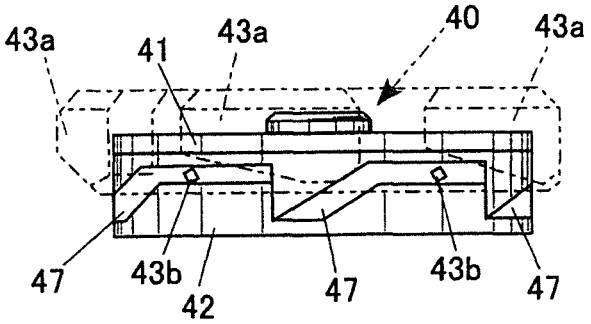
FIG. 11B illustrates the engaging mechanism between the projections and the grooves according to the first embodiment, where the bumps are at the upper position.

When the bumps 43*a* of the toy top 1 in the state illustrated in FIG. 10A and FIG. 11A collide with an opponent toy top and thereby are subjected to an impact in the direction toward the spinning rear of the toy top 1, the bumps 43*a* move upwardly to the spinning rear side so as to absorb and reduce the impact. Further, since the bumps 43*a* subjected to the impact ascend higher than the body of the opponent toy top as illustrated in FIG. 10B and FIG. 11B, they strike the opponent toy top downward from above.

When applying a spinning force by the launcher 60, the bumps 43*a* move upwardly to the spinning rear side since the toy top 1 starts spinning. Instead, the bumps 43*a* may be moved upwardly to spinning the rear side so that the projections 43*b* are located in the flat groove portions 47*b* of the guide grooves 47 before applying the spinning force. Thereafter, when the toy top 1 is launched and the body is subjected to an impact, the projections 43*b* are dislocated from the flat groove portions 47*b* of the guide groove 47 by an inertial force on the ring 43 and the bumps 43*a* consequently descend. This lowers the center of gravity of the toy top 1 so as to increase the stability of the spinning toy top 1. Further, the descent of the bumps 43*a* changes the attacking function.

Figure 12:
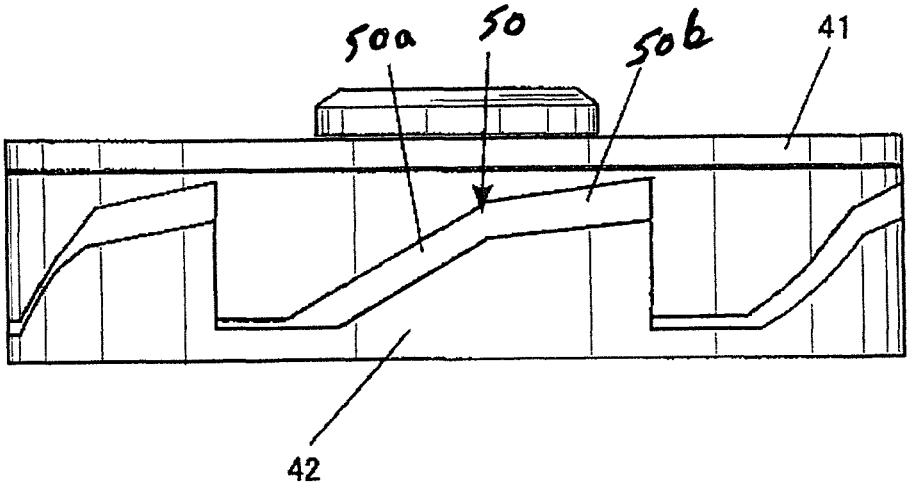
FIG. 12 illustrates a groove of a toy top according to a second embodiment.

FIG. 12 illustrates guide grooves 50 of a toy top according to a second embodiment. Each of the guide grooves 50 of the toy top includes an inclined groove portion 50*a* that is located in the spinning front side, and a gently inclined groove portion 50*b* that is located in the spinning rear side and has a gentler slope than the inclined groove portion 47*a* described above. The inclined groove portion 50*a* and the gently inclined groove portions 50*b* are upward slopes toward the spinning rear side.

With the inclined groove portions 50*a* and the gently inclined groove portions 50*b*, the guide grooves 4750 of this alternate embodiment have the following functions and advantageous effects.

In the inclined groove portions 50*a*, the bumps 43*a* in the upper position descend more readily in the late stage where the toy top 1 spins at low speed. Once the bumps 43*a* reach the lowest position, the toy top 1 can keep spinning for a long time since the center of gravity is at a stable position. In the gently inclined groove portions 50*b*, the bumps 43*a* readily move to the spinning rear side when the toy top 1 is attacked by an opponent toy top in the direction toward the spinning rear side in the early stage where the top toy 1 spins at high speed. This facilitates fending off the attack by the opponent toy top. In particular, the bumps 43*a* with the inclined lower faces can effectively fend off the attack by the opponent toy top.

In the first and second embodiments, by selecting the weight of the ring 43, the inclination of the guide groove 47, 50, the surface condition of the groove edge of the guide groove 47, 50, and the like, it is possible to configure the bumps 43*a* to descend to the lowest position by the weight of the ring 43 when the toy top 1 is not spinning in the upright position. The surface condition includes elements that affects movement of the ring 43, for example, a material (e.g. rubber) and texture (e.g. unevenness). By selecting the same characteristics, it is also possible to configure the bumps 43*a* to stay in the middle of the groove edge. In particular, in the second embodiment, it is possible to configure the bumps 43*a* to stay in the corresponding position when the projections 43*b* are engaged with the gently inclined groove portion 50*b* but the bumps 43*a* to descend to the lowest position by the weight when the projections 43*b* are engaged with the inclined groove portion 50*a*.

While a few embodiments of the present invention are described, the present invention is not limited to these embodiments, and a variety of changes can be made without departing from the features of the present invention.

For example, in the above-described embodiments, the inclined groove portions 47*a*/50*a* of the guide groove 47, 50 are upward slopes toward the spinning rear side of the toy top 1. However, when the toy top is configured to be able to spin in either direction, the guide groove 47, 50 may be formed in a trapezoidal or triangular shape in a view from the outside in the radial direction.

Further, the six bumps 43*a* are formed on the ring 43. Instead, the bumps 43*a* may be individually attached to the body so as to be able to reciprocate independently from each other in the circumferential direction.

In the above-described embodiments, the guide grooves 47, 50 are defined by the sawtooth protruded wings 41*e* and the cutouts having the similar shape with the protruded wings 41*e*. Instead, the upper half of the guide grooves may be formed in the upper plate 41 while the lower half may be formed in the lower plate 42. It is only necessary that guide grooves 47, 50 be formed to which the projections 43*b* can be inserted.

The entire disclosure of Japanese patent application No. 2017-023036, filed on Feb. 10, 2017, is incorporated herein by reference in its entirety.

What is claimed is:

1. A toy top, comprising: a body having a circumference, a first portion on which one of a guide groove or a projection is formed, and a second portion of which is movable relative to the first portion and on which the other of the guide groove or the projection is formed; and a bump projecting from a circumference of the second movable portion, wherein the guide groove includes—an inclined groove portion which has a predetermined inclination with respect to a horizontal plane so as to be an upward slope to a rear side in a spinning direction of the toy top, and one of a flat groove portion or a gently inclined groove portion which continues to the inclined groove portion to the rear side in the spinning direction of the toy top, wherein the gently inclined groove portion has a gentler inclination than the inclined groove portion so as to be a gentler upward slope to the rear side in the spinning direction of the toy top than the upward slope of the inclined groove portion, wherein the second movable portion of the body is engaged with the first portion of the body by inserting the projection into the guide groove, wherein the second movable portion with the bump thereon moves up and down relative to the first portion of the body with movable cooperation between the guide groove and the projection according to a direction of a force acting on the bump while the toy top spins, and wherein an end of the flat groove portion or the gently inclined groove portion opposite to the inclined groove portion is a dead end so that the projection cannot move further than the dead end to the rear side in the spinning direction of the toy top.

2. The toy top according to claim 1, wherein the guide groove is formed on the first portion of the body, and the projection is formed on the second, movable portion of the body.

3. The toy top according to claim 1, wherein the first portion of the body has an upper plate and a lower plate, each having respective wall/groove portions, and wherein the guide groove is formed by putting the upper plate and the lower plate together to bring the groove/wall portions of the upper plate and the lower plate together in spaced relation.

4. The toy top according to claim 1, wherein the second movable portion is a ring which is coaxial with the body.

5. The toy top according to claim 1, wherein the bump is a plurality of bumps equally spaced along a circumference of the second portion.

6. The toy top according to claim 1, further comprising a decoration part which is removably received by the body and which identifies the toy top.

7. The toy top according to claim 3, wherein each of the wall/groove portions of the upper plate is a wing that includes a vertical face, a flat face and an inclined face.

8. The toy top according to claim 7, wherein each wing is equally spaced perpendicularly along a circumference of the upper plate.

9. The toy top according to claim 1, wherein the guide groove is a plurality of guide grooves equally spaced along the circumference of the body.

10. The toy top according to claim 1, wherein the bump has an upper face that is flat.

11. The toy top according to claim 10, wherein the bump has a lower face that is inclined.

12. The toy top according to claim 1, wherein the projection is a plurality of projections equally spaced along an inner circumference of the second movable portion.

13. The toy top according to claim 12, wherein each projection is a rhombic shape.

14. The toy top according to claim 1, wherein the guide groove is one of a trapezoidal or triangular shape.

* * * * *